United States Patent [19]

Hopper

[11] 4,194,550

[45] * Mar. 25, 1980

[54] APPARATUS FOR INSULATING AGAINST CONDUCTIVE, CONVECTIVE AND RADIANT HEAT TRANSMISSION

[75] Inventor: Thomas P. Hopper, Durham, Conn.

[73] Assignee: Insulating Shade (Limited Partnership), Branford, Conn.

[ * ] Notice: The portion of the term of this patent subsequent to Aug. 2, 1994, has been disclaimed.

[21] Appl. No.: 816,920

[22] Filed: Jul. 19, 1977

Related U.S. Application Data

[63] Continuation-in-part of Ser. No. 652,628, Jan. 26, 1976, Pat. No. 4,039,019.

[51] Int. Cl.[2] ..... E06B 9/08

[52] U.S. Cl. ..... 160/121 R; 160/107

[58] Field of Search ..... 160/25, 41, 120, 121, 160/122, 237, 238, 271, 107, 5

[56] References Cited

U.S. PATENT DOCUMENTS

| | | | |
|---|---|---|---|
| 1,908,989 | 5/1933 | Lahey et al. | 160/25 |
| 2,247,634 | 7/1941 | Houston | 160/121 |
| 2,341,123 | 2/1944 | Schweller | 160/25 |
| 3,236,290 | 2/1966 | Lueder | 160/241 |
| 3,253,644 | 5/1966 | Gotoh et al. | 160/107 |
| 3,294,151 | 12/1966 | Hartley et al. | 160/5 |
| 4,039,019 | 8/1977 | Hopper | 160/121 |

*Primary Examiner*—Peter M. Caun

*Attorney, Agent, or Firm*—St. Onge, Mayers, Steward & Reens

[57] ABSTRACT

An apparatus for insulating against conductive, convective, and radiant heat transmission comprises a plurality of mutually parallel sheets. The sheets may be attached to a retracting device from which they can be drawn to extend in mutually parallel relation and cover a building opening such as a window or onto which they can be retracted to uncover the opening. A number of spacers which may be in the form of collapsible or nestable devices are mounted within the apparatus to separate each pair of adjacent sheets and, thus, define a dead air space therebetween. At least one of the sheets has a surface, facing on the dead air space, that exhibits a low surface emittance. This surface emittance is sufficiently low to yield a total effective emissivity of the surface and dead air space of no greater than 0.60. Important, the spacer devices are designed so as not to abrade or otherwise harm the reflective surface. The combination of these dead air spaces with the low emittance surface synergistically results in an apparatus having low total effective emissivity that effectively impedes radiant heat transfer. The dead air spaces also effectively impede conductive and convective heat transfer.

91 Claims, 19 Drawing Figures

FIG. 4
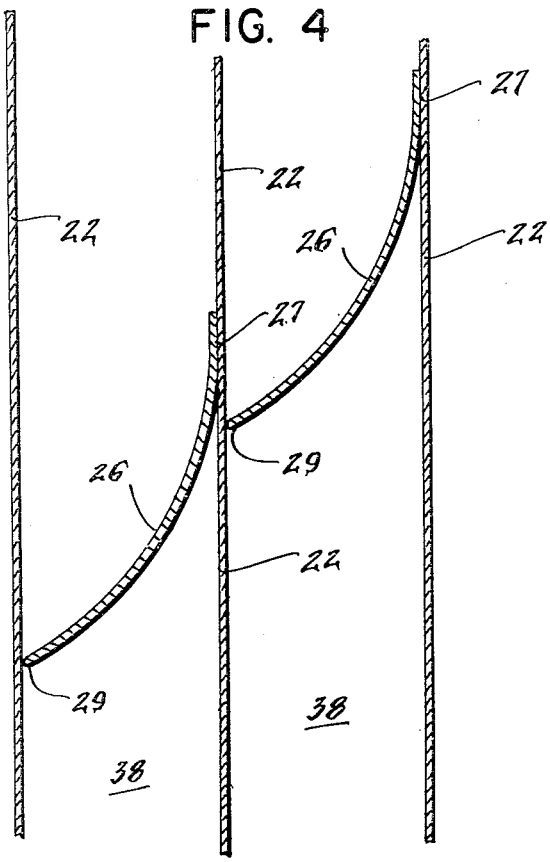
FIG. 5
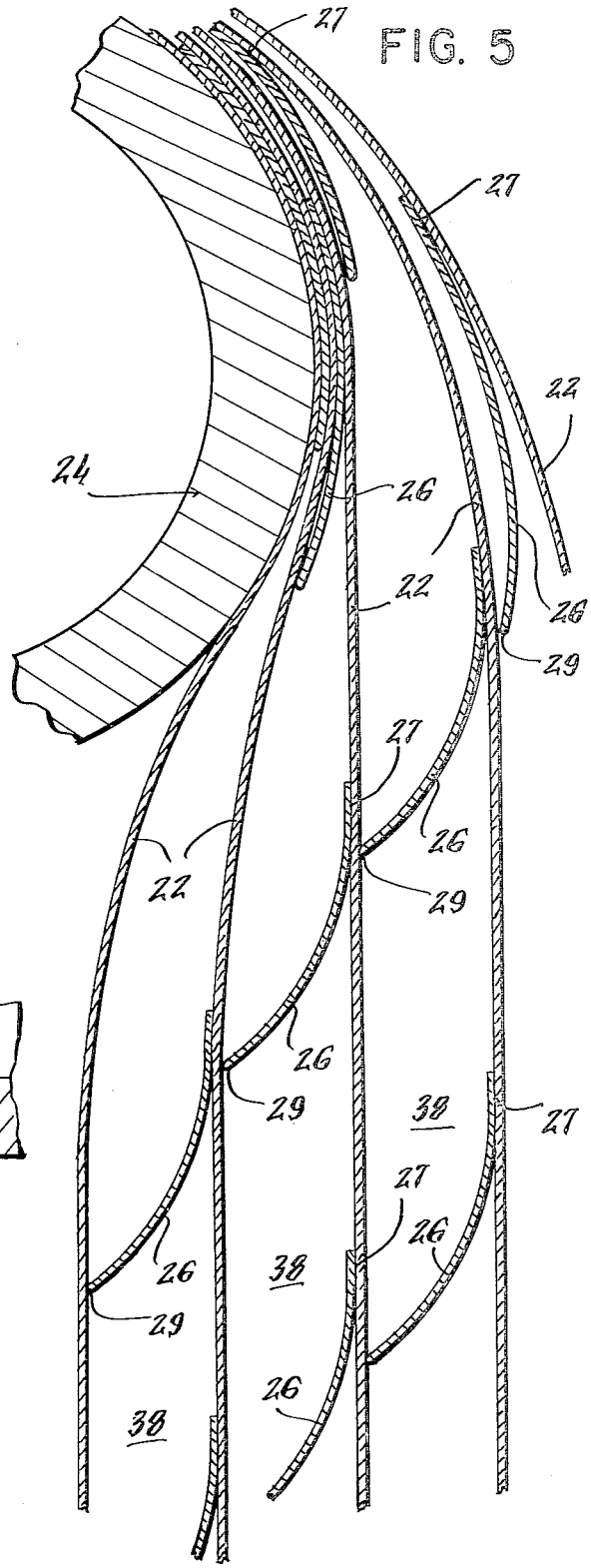
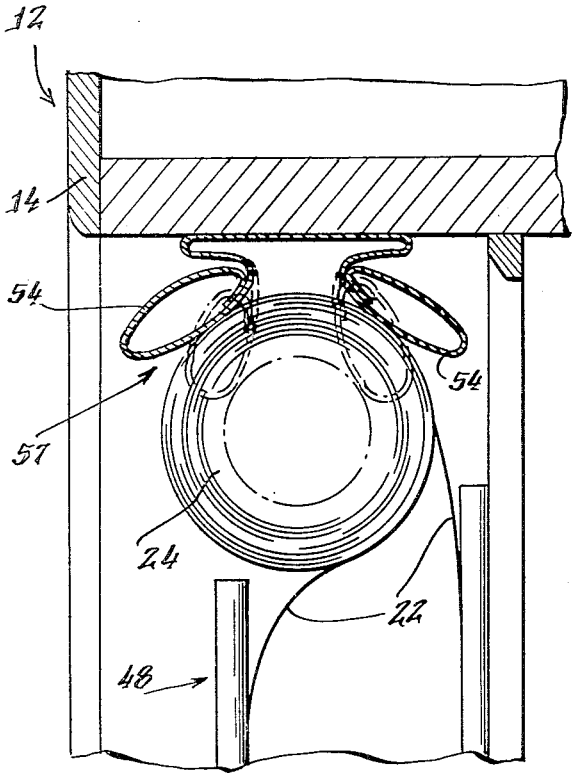
FIG. 6

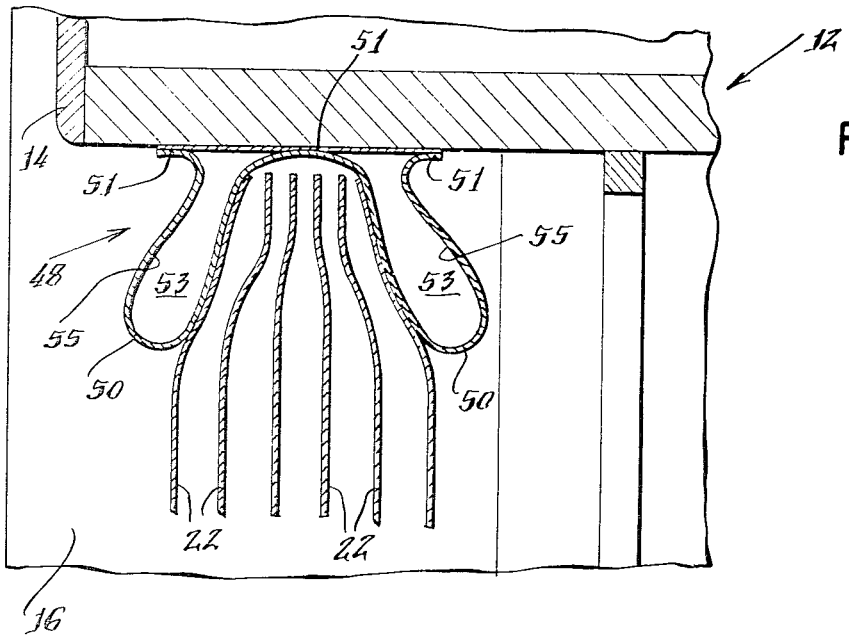
FIG. 7
FIG. 8
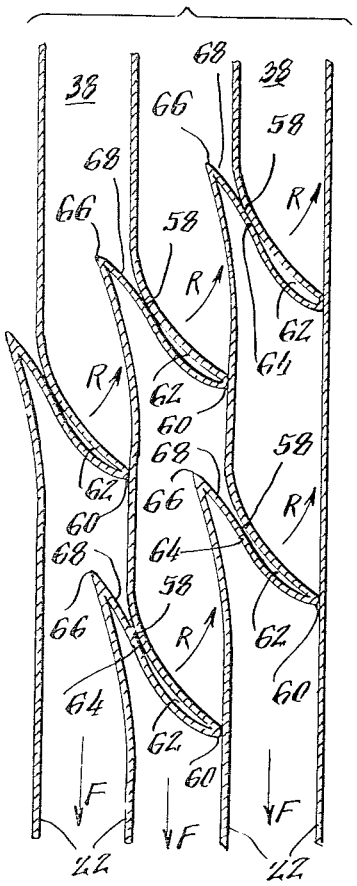
FIG. 9
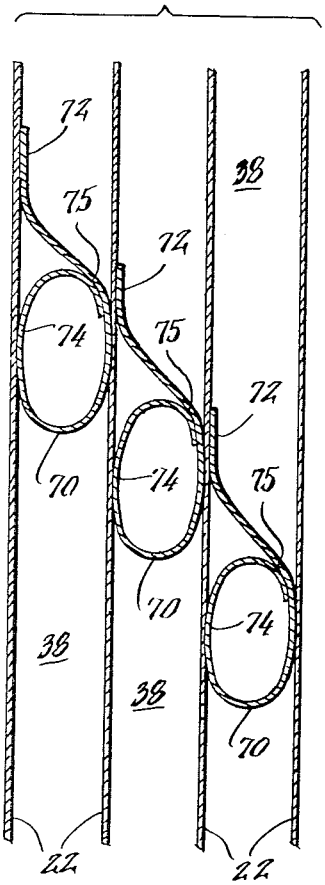
FIG. 10
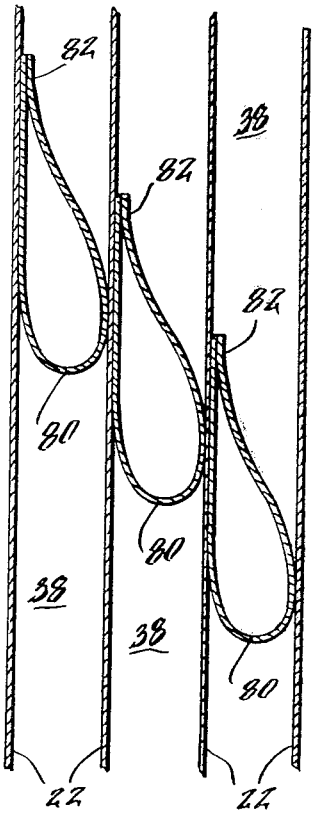

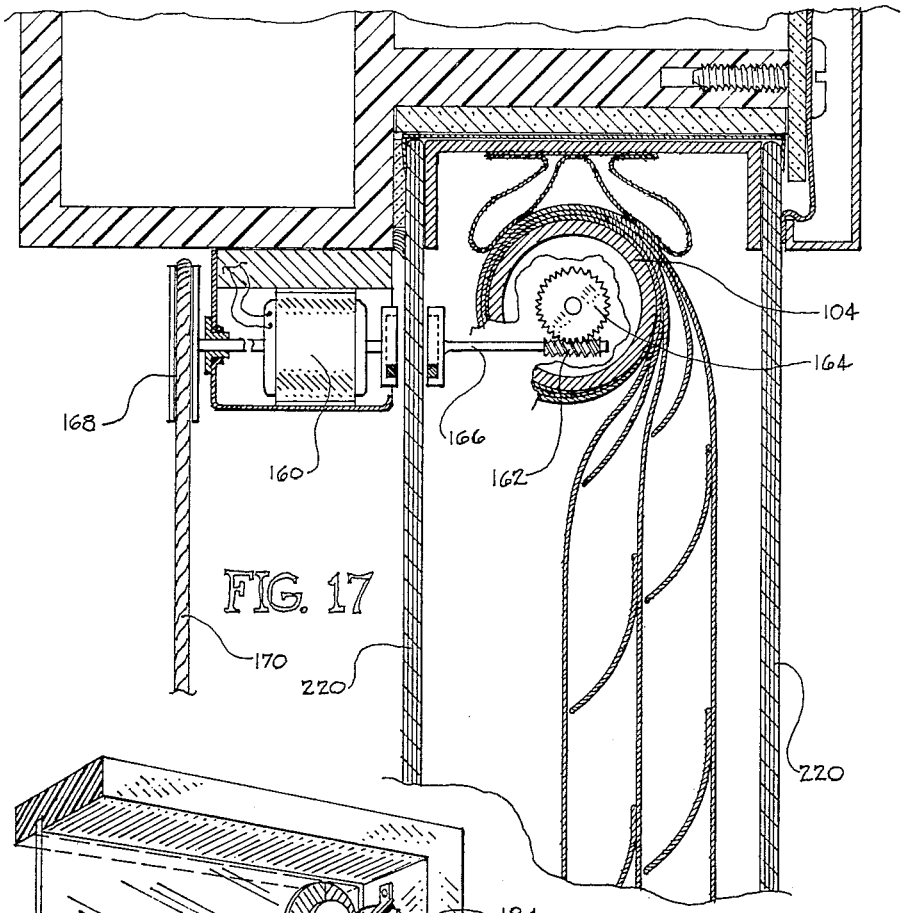
FIG. 17
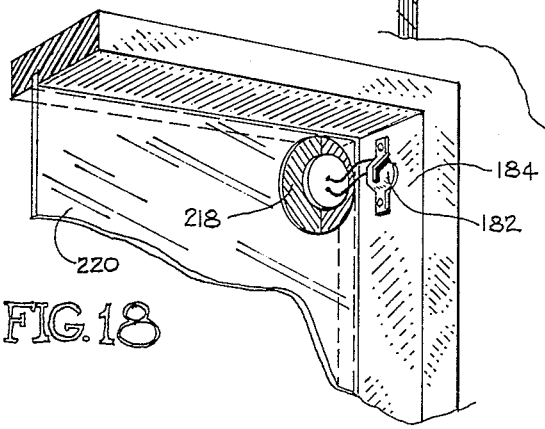
FIG. 18
FIG. 19
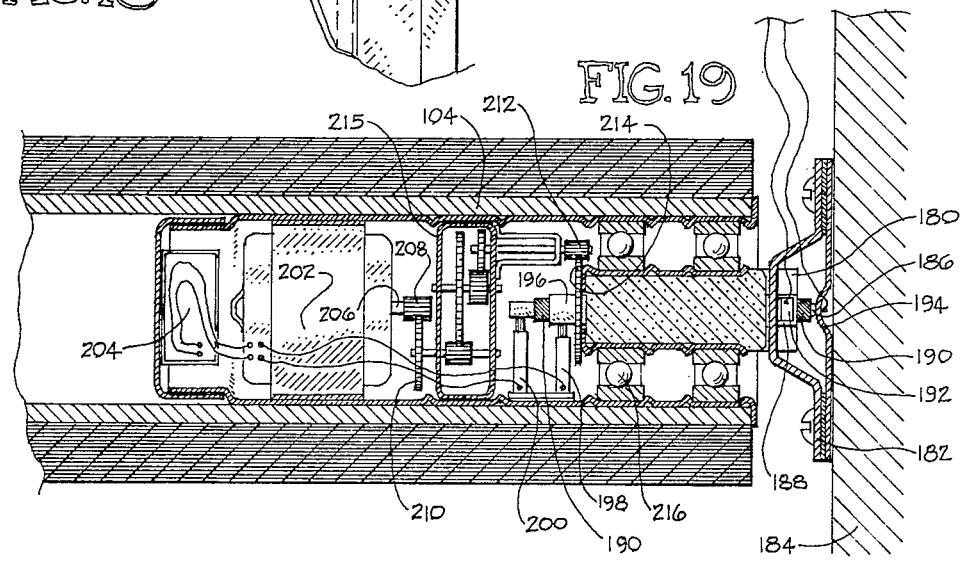

APPARATUS FOR INSULATING AGAINST CONDUCTIVE, CONVECTIVE AND RADIANT HEAT TRANSMISSION

BACKGROUND OF THE INVENTION

This patent application is a continuation-in-part of U.S. patent application Ser. No. 652,628 filed Jan. 26, 1976 now U.S. Pat. No. 4,039,019 (Hopper).

FIELD OF THE INVENTION

The present invention relates to an apparatus for providing insulation against radiant, conductive, and convective heat transmission in areas in which only relatively thin insulators may be installed. This apparatus may take the form of a shade and may be used to insulate areas such as windows and doors in residential, commercial, and industrial buildings that ordinarily are relatively good heat transmitters.

It has become increasingly apparent in recent years that presently known sources of energy derived from the earth are finite and are, in fact, being rapidly depleted. Therefore, energy conservation has become a subject of great national concern.

The heating and cooling systems of residential, industrial, and commercial buildings use approximately 25% of all energy consumed in the United States. It is important to note, therefore, that transparent single pane or double insulated pane windows in these buildings are very poor heat insulators and consequently represent a significant cause of inefficient energy consumption. For example, in winter the heat loss per unit area through windows is typically three to ten times as great as that through adjacent walls depending on the type of wall insulation. Similarly, in summer the total heat entering through a sunlit window may be more than ten times that through the adjacent wall. (See, ASHRAE, Handbook of Fundamentals (1972); R. C. Dix and Z. Lanvan; "Window Shades and Energy Conservation"; Mechanics, Mechanical and Aerospace Engineering Department, Illinois Institute of Technology, 1974). Therefore, substantial amounts of energy can be saved if window areas are effectively insulated. However, it is desirable to do so without permanently blocking windows and thus preventing their use for ventilation as well as for visual access to the outside world.

It may also be advantageous to insulate other areas where the permissible thickness of insulation is limited.

DESCRIPTION OF THE PRIOR ART

Various attempts have been made to provide insulation against heat transmission through building areas such as windows where only thin apparatus can be installed. For example, research conducted at the Illinois Institute of Technology by R. C. Dix and Z. Lavan and published under the title "Window Shades and Energy Conservation" shows that a simple, single-sheet window shade is superior to either draperies or venetian blinds in preventing unwanted heat loss through windows. Further, the insulating effect is improved if the shade is sealed at its edges with tape and provided with a white or silver reflective suface (Id. at 23).

U.S. Pat. No. 2,305,085 (Smith) discloses a thermally insulating window shade construction that is retractibly mounted at the top of a window frame and includes two shades sheets separated by a spacer in the form of a wooden rod fixed with the window frame. However, this device has certain practical disadvantages. The spacer rod has a tendency to abrade the sheets when drawn past it causing them to wear. Further, no provision is made for sealing the shades to the window frame or for otherwise preventing convection air currents from developing in the space between the shade sheets when drawn over the window. This is a major source of breakdown of insulating effectiveness provided by the Smith construction.

ASHRAE, Handbook of Fundamentals (1972) considers the total emissivity of two surfaces having various average emissivities which enclose a single air space. However, no mechanical structure is disclosed.

Other shade constructions are disclosed in U.S. Pat. Nos. 2,140,049 (Grauel); 2,328,257 (Butts); and 2,865,446 (Cole). Each of these constructions is designed to control the admission of light and air through a window in the manner of a conventional conventional shade and is not well suited for use as an insulator against heat loss. For example, the shade apparatus disclosed in the Grauel and Butts Patents include perforated sheets which induce convection air currents about the shade sheets and windows on which the sheets are installed. Similarly, the shade sheets used by the Cole device are made of an open mesh fabric which would not prevent development of such convection air currents.

A pneumatically-actuated roll-up closure is disclosed in U.S. Pat. No. 3,231,006 (Fisher et al. and includes multiple layers which define inflatable, fluid containing pockets. However, the Fisher device is not intended to be an insulator and nowhere in the patent does the inventor consider the desirability of providing surfaces of its multiple layer construction with low emissivity characteristics. In particular, the limits of emissivity which provide an acceptable structure in accordance with the present invention are nowhere mentioned.

Other window closing apparatus are disclosed in the U.S. Pat. Nos. 2,247,634 (Houston); 2,324,423 (Pidgeon); and 2,361,762 (Glenn et al.). However, both apparatus are as poor heat insulators as are conventional windows.

SUMMARY OF THE INVENTION

As described below in detail, the apparatus of the present invention is mounted to temporarily or permanently cover an area to be insulated against heat transmission. The area may be a wall or an opening, such as a window, in a building. When embodied in its preferred form, used to insulate a window, the apparatus functions as a shade which may be either completely drawn or opened or set in any position in between and, consequently, need not inhibit normal operation of the window to admit air for ventilation or to admit light. However, when the shade apparatus is drawn at night during the winter months, significant energy savings are realized by preventing substantial loss of heat, generated by the heating system of the building, through the window. Similarly, when this shade apparatus is drawn during the day in the summer months, significant energy savings are realized by limiting admission of heat and thus reducing the need for cooling ordinarily provided by the air conditioning system of the building.

The shade apparatus of this preferred embodiment is designed for use with conventional windows, for example, those of the double hung type slidably mounted in a frame. The apparatus includes a plurality of opaque or translucent, that is, essentially non-transparent, imperforate shade sheets, which are attached to a retracting roller that is mounted to horizontally span the window frame at its upper end. The sheets may be drawn downwardly from the roller to cover the window or may be retracted back onto the roller to uncover the window. Of course, the shade apparatus may be mounted to be drawn sidewardly across the window.

A number of spacers are mounted with one sheet of each pair of adjacent shade sheets to separate those sheets, when they are drawn to cover the window, to define dead spaces therebetween. These spacers may be collapsible or nestable so that when retracted onto the roller, the layers of sheets may be tightly compacted thereon. Further, since the spacers are mounted with individual shade sheets and travel with them during drawing and retracting operations, minimal abrasion which would tend to wear the sheet or scratch the surface occurs. Other non-abrading spacer embodiments which are not mounted with the shade sheets are also disclosed.

A low emittance surface is associated with at least one of the sheets and faces on a dead air space. The surface emittance of the surface is sufficiently low to yield a total effective emissivity of the surface and dead air space of no greater than 0.60. The surface emittance of the surface is, in particular, no greater than 0.60.

Thus, dead air spaces defined between adjacent shade sheets form an effective thermal insulator against conductive and convective heat transmission. Moreover, the low surface emittance surfaces, in cooperation with these multiple dead air spaces, provide an apparatus having low total emissivity, highly effective to impede radiant heat transfer.

The shade apparatus of the present invention also provides certain practical advantages. In particular, it can be installed as easily as a conventional shade using similar hardware. Since the low emittance surfaces incorporated in the apparatus are not abraded or scratched by the spacers which either travel with the sheets or are fixed, a long useful life of the shade apparatus to effectively insulate a window against heat transmission may be realized. Since the apparatus is simple it may be economically manufactured and, therefore, placed in wide use.

The apparatus of the invention may be used to insulate other building areas such as floor-to-ceiling length windows, sliding glass or non-glass doors and conventional doors. Further, the apparatus may be embodied in forms other than a shade. For example, it may be mounted in extended, non-retractible fashion to insulate a wall or other area and may be mounted to extend horizontally, vertically or obliquely.

Accordingly, it is an object of the present invention to provide an apparatus which effectively and practically insulates against convective, conductive, and radiant heat transmission through building areas which permit installation of devices having relatively narrow thickness.

Other objects, aspects, and advantages of the present invention will be pointed out in, or will be understood from the following detailed description provided below in conjunction with the accompanying drawings.

BRIEF DESCRIPTION OF THE DRAWINGS

FIG. 4 is a further enlarged partial cross-sectional view similar to that shown in FIG. 3 illustrating preferred devices for spacing adjacent shade sheets apart to define a dead air space therebetween.

FIG. 5 is a second enlarged cross-sectional view of these spacer devices showing the manner in which they collapse or nest when retracted onto the roller.

FIG. 6 is a vertical cross-sectional view of an arrangement for sealing the top of the shade apparatus, alternative to that shown in FIG. 3, to prevent convection currents from developing between the apparatus and the window.

FIG. 7 is a vertical cross-sectional view taken through plane 7—7 in FIG. 1 looking downward showing a suitable arrangement for sealing the sides of the shade apparatus to prevent development of such convection currents.

FIGS. 8, 9 and 10 are enlarged partial vertical cross-sectional views similar to that shown in FIG. 3 illustrating alternative devices for spacing adjacent shade sheets apart to define a series of dead air spaces.

FIG. 17 is a vertical cross-sectional view of an automatically and/or remotely operable embodiment of the invention.

FIG. 18 is a perspective view showing the location of a photovoltaic cell for operating the automatic embodiment of the invention shown in FIG. 17.

FIG. 19 is a vertical cross-sectional view of another automatic embodiment of the invention.

DETAILED DESCRIPTION OF THE PREFERRED EMBODIMENTS

Figure 1:
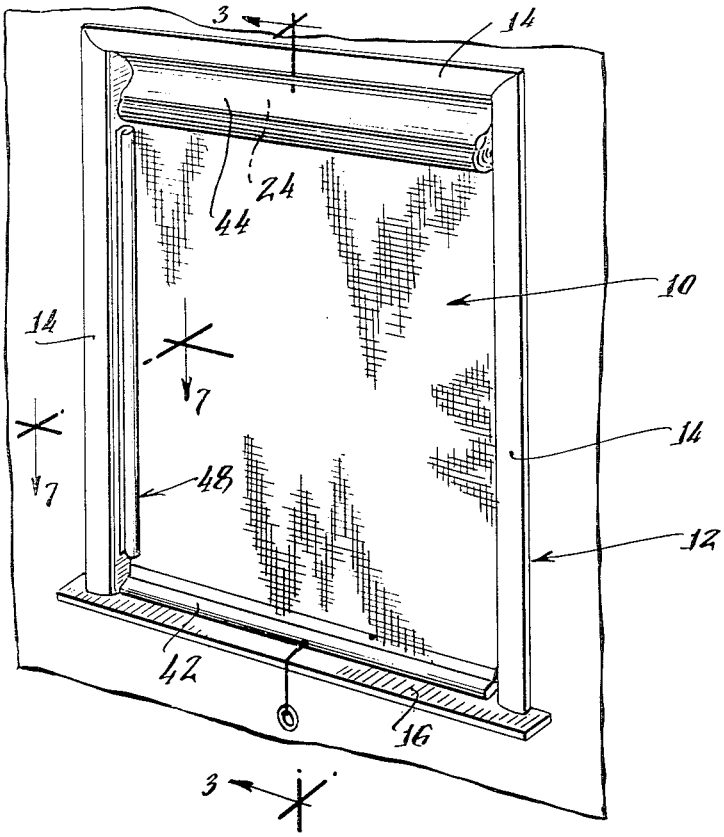
FIG. 1 is a perspective view illustrating the shade apparatus of the present invention in its drawn position from the inside of a conventional window in which it is mounted.
Figure 2:
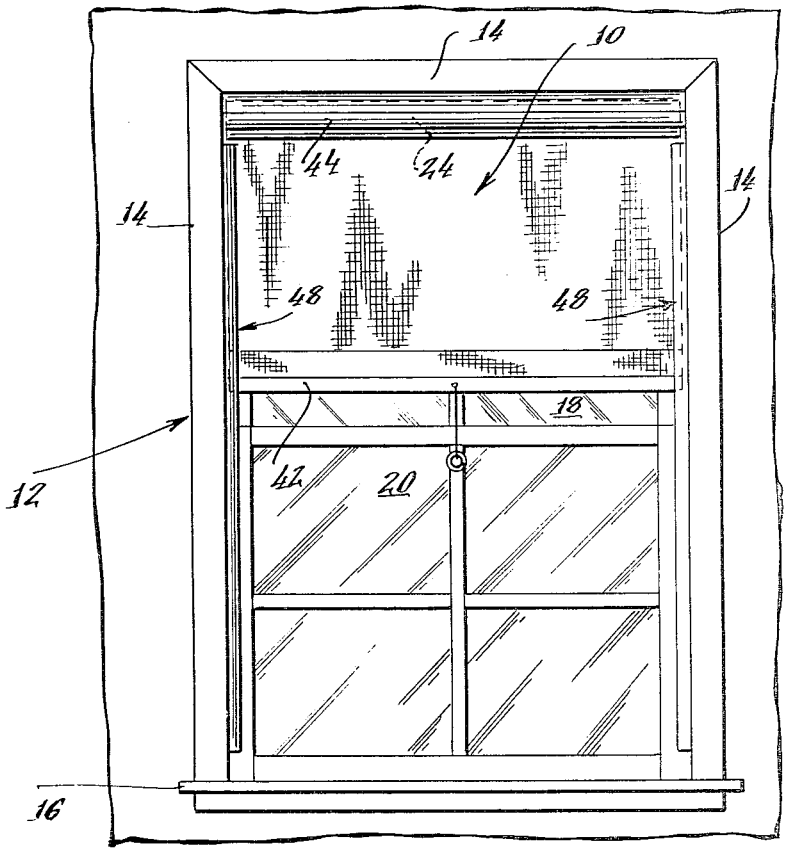
FIG. 2 is a front elevational view of this shade apparatus, also from the inside of the window in which it is mounted, illustrating it in a partially drawn position.

As shown in FIGS. 1 and 2, the apparatus of the present invention, embodied in the form of a shade and generally indicated at 10, is mounted to be drawn over a conventional window, generally indicated at 12, to insulate the window against convective, conductive and radiant heat transmission. However, this shade apparatus may be used with equal advantage to insulate any other opening, such as a sliding glass door, in a commercial, institutional, industrial or residential building against heat transmission. Similarly, it may be embodied as a permanent non-retractible insulator for, as an illustration, a wall. Nevertheless, by way of example, the window 12 may be of the double hung type which comprises a frame 14 that extends about the sides and top and a sill 16 that projects horizontally outwardly from the bottom. A closure in the form of upper and lower multiple glass panes, 18 and 20 respectively, is mounted in a well-known manner with each pane slidably carried in vertically extending tracks (not shown)

for upward and downward movement. Further, these glass panes are recessed in the frame 14.

Figure 3:
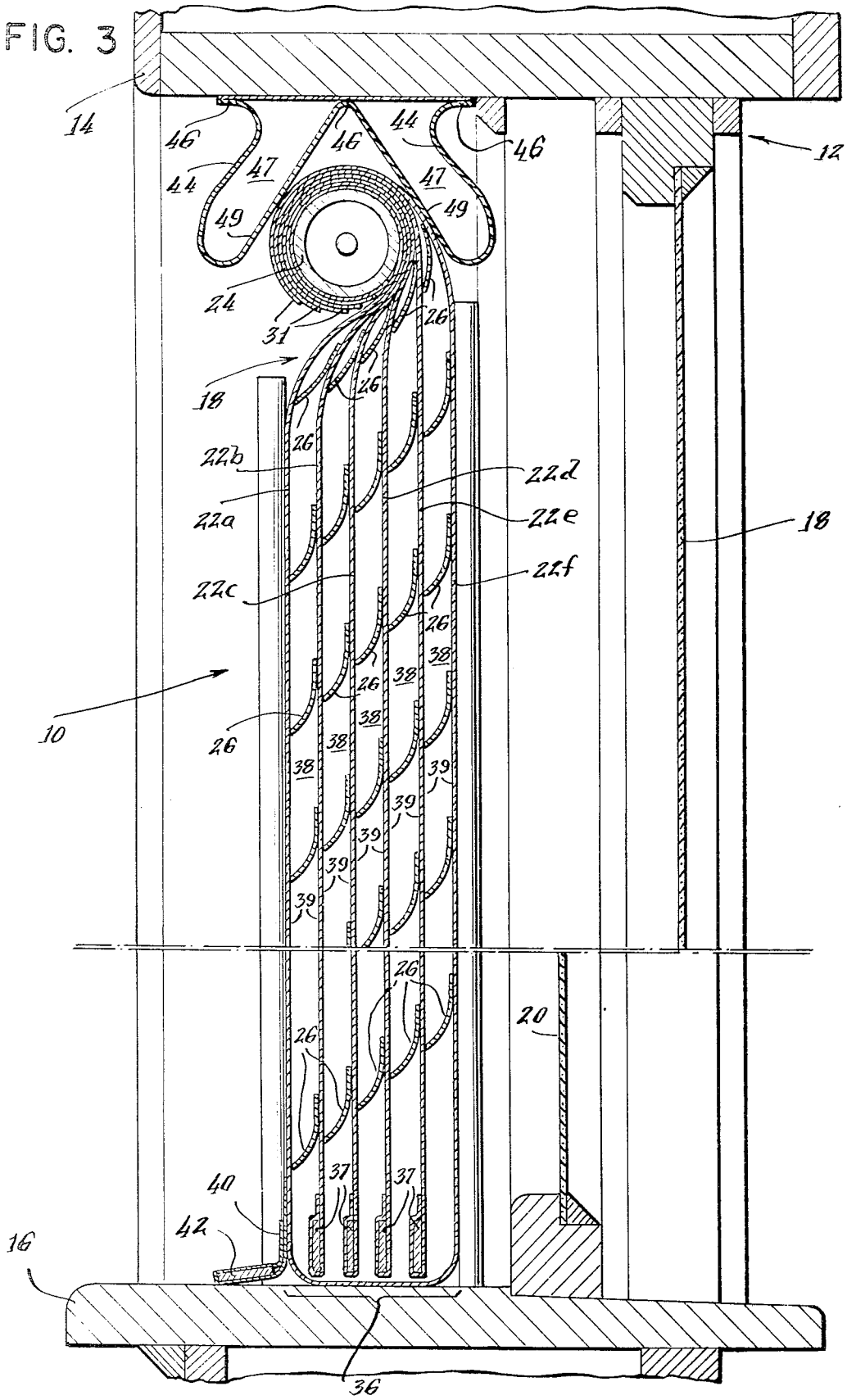
FIG. 3 is a vertical cross-sectional view of this shade apparatus and window taken through plane 3—3 in FIG. 1 looking toward the left.

As shown in FIG. 3, the shade apparatus 10 includes a number of essentially non-transparent, imperforate shade sheets 22 which are attached to a retracting roller 24 that is mounted to horizontally span frame 14 at its upper end. (Note that the thickness of shade sheets 22 is exaggerated in the interest of clarity.) Readily available or slightly modified hardware may be used to mount the roller which may advantageously include a conventional, spring-loaded retracting mechanism (not shown) like that commonly used in ordinary window shades. This retracting mechanism provides a means for moving the shade sheets between a drawn position (FIGS. 1 and 3) and a tightly compacted, retracted position.

One sheet of each pair of adjacent shade sheets 22 is provided with a number of devices 26 for spacing the adjacent sheets apart when in the drawn position as shown in FIG. 3. Moreover, these spacer devices may be mounted more closely together at the top of each sheet to effectively separate adjacent sheets in the region where they tangentially leave roller 24 and thus have a tendency to lie together.

In the preferred embodiment as shown in detail in FIG. 4, each spacer device 26 is formed of an elongated elastic tape-like strip to assume a partially cylindrical or arcuate shape having an axis parallel to the major axis of the tape-like strip, and is attached, for example by heat welding or sewing, at its upper edge 27 to the sheet surface to extend horizontally or transversely thereacross. (Note that the thickness of spacer devices 26 is also exaggerated in the interest of clarity.) However, the lower edge 29 of each device is free. Further, each device 26 is made from a material having a high "elastic memory", that is, the material when formed to its desired arcuate shape, naturally reverts to that shape after deformation. Additionally the devices should be heat set to avoid loss of the "elastic memory" in summer heat. Accordingly, devices 26 separate adjacent sheets along the entire extended sheet length in order to define a dead air space 38 therebetween. Therefore, these dead air spaces operate as insulators against conductive and convective heat transmission.

As shown in FIG. 5, the spacer devices 26 tightly compact on roller 24 when the shade sheets 22 are retracted thereon by virtue of their design. Specifically, the radius of curvature of each spacer device matches the radius of the roller 24 as it rolls thereon and the lower strip edge 29 slides only slightly downwardly on the sheet adjacent that to which it is attached. The free end 29 is preferably rounded to insure that the sliding movement, though slight, is also smooth. However, since the spacer device has high elastic memory, when the apparatus is extended from roller 24, each device tends to maintain or remember the radius of the roller 24 to space adjacent sheets apart in a manner opposite to that when the sheets are retracted.

Referring again to FIG. 3, the trailing ends 31 of the respective sheets 22 are attached to the curved roller surface in circumferentially staggered fashion. The spacer devices are also staggered from one sheet to the next in slanted vertical arrays so that only a small portion of one collapses against another on an adjacent sheet when the apparatus is retracted. Accordingly, distribution of the sheet and spacer device material is relatively even when the apparatus is retracted onto the roller. Therefore, though the apparatus may comprise many sheets, they are stored on roller 24 in a relatively compact way to occupy little more space than an ordinary shade. For example, it has been found that an apparatus having three sheets that is eight feet long and has thickness of one and one-half inches when extended, has a retracted diameter of two inches on a roller having a diameter of one inch.

As shown in FIG. 3, the outermost sheets **22*a* and 22*f* are interconnected at location 36 by virtue of being formed of the same sheet of material. Further, each of the single internal sheets 22*b* through 22*e* is provided with an elongated weight 37 at its leading end to provide full sheet extension to a point contacting or nearly contacting continuous sheet 22*a*–22*f* at location 36. The respective dead air spaces 38 are, thus, sealed at the bottom by the outer sheets 22*a* and 22*f* and their contact with the internal sheets 22*b*–22*e*** to prevent the development of convection air currents therein. This is particularly desirable since such convection currents would interfere with effective operation of the dead air spaces to prevent conductive and convective heat transmission.

As the sheets are retracted onto the roll, the radii of the sheets outermost from the roller axis are greater than that of those nearer the roller axis. Therefore, sheet **22*f* will be retracted onto roller 24 more rapidly than sheet 22*a*. However, the continuous shade sheet construction permits easy retraction without binding in spite of this occurrence since the sheet 22*a*–22*f* pivots at location 36. Moreover, the weighted ends of internal sheets 22*g*–22*e* retract in staggered fashion because of the difference in radius to the respective sheets on the roller. Suitable discs or large washers may be installed at the ends of roller 24** to insure that the sheets retract evenly thereon.

In accordance with the present invention, at least one of the shade sheets is provided with a low emittance surface 39 facing on a dead air space 38. Emittance is defined as the ratio of the total radiant flux emitted by a surface to that emitted by an ideal black body at the same temperature. In the preferred embodiment, at least one and preferably both sides of each of the internal sheets **22*b*–22*e*** have a low emittance surface and may be, for example, copper, nickel, aluminum, silver or gold foils or foils of alloys of these metals. Material sold under the trademark "Mylar" by the E. I. DuPont de Nemours & Co., when provided with an aluminized coating, is also suitable for use as the shade sheets to provide low emittance surface.

It has been found that each low emittance surface should have a surface emittance sufficiently low to yield a total effective emissivity of the surface and its associated dead space of no greater than 0.60. Effective emissivity is defined as the combined effect of the boundary surface emittances and dead space. Therefore, the maximum acceptable surface emittance of a single surface 39 facing on a single dead space 38 is 0.060.

In the preferred embodiments of the invention each low emittance surface has a surface emittance sufficiently low to yield a total effective emissivity of the surface and associated dead space of no greater than 0.06. Thus the maximum preferred surface emittance of a single surface 39 facing on a single dead space 38 is 0.06. The acceptable surface emittance value can be obtained with any of the materials mentioned above.

Further the acceptable and preferred surface emittance and total effective emissivity values described above should be achieved in the infrared range of the energy spectrum and in the temperature range of 30° F. to 130° F.

In light of the description provided above, the term "low surface emittance" is accordingly defined as a surface emittance of no greater than 0.60.

The low emittance surfaces synergistically combine with an associated dead air space to effectively insulate against radiant heat transmission. To illustrate, if thermal conductance U is defined as the time rate of heat flow through a body (frequently per unit area) from one boundary surface to another for unit temperature difference under steady conditions, and thermal conductance R is defined as the reciprocal of thermal conductance, then R is a measure of the effectiveness of a body to prevent heat transmission. The thermal resistance $R_f$ of each surface, or the film resistance, of a free standing shade sheet, independent of surface emittance, is 0.68. Thus, the total thermal resistance, which is additive, of the entire shade sheet is $R_1=2R_f=1.36$. The thermal resistance of two high surface emittance shade sheets spaced apart to form a dead air space is $R_2$ and is equal to the outer film resistance of both sheets, $2R_f=1.36$, plus the thermal resistance of the air space, $R_{as1}=0.96$. Therefore, $R_2=2R_f+R_{as1}=2.32$. This, of course, would also be the expected resistance of the shade configuration if the sheets had low surface emittance. However, when the sheets are provided with low emittance surfaces, as defined above, facing on the air space, the thermal resistance of the air space is increased to $R_{as2}=2.95$ so that the total resistance $R_3=2R_f+R_{as2}=4.31$. Similar results are achieved as more air spaces are added. Accordingly, the apparatus of the present invention comprising a plurality of shade sheets enclosing a plurality of dead air spaces each associated with a low emittance sheet surface, effectively insulates against convective, conductive, and radiant heat transmission.

In accordance with the present invention, it is particularly important that the spacer devices do not damage low emittance surfaces when a retracting mechanism is provided. A stationary non-rotatable spacer past which the shade sheets are drawn would abrade these surfaces attached to or forming a part of the sheet face, degrade its low emittance characteristic and thus limit its effectiveness in conjunction with the dead air spaces to insulate against heat transmission. However, spacer devices of the type described above keep surface abrasion to a minimum and thus preserve and extend the useful life of the apparatus.

The shade apparatus of the present invention also incorporates certain features which prevent development of convection currents between the apparatus and the window itself. As shown in FIG. 3, a flap 40 is attached to the outermost shade sheet 22*a* and is weighted by an elongated rod 42 to firmly contact the upper surface of sill 16 when the shade apparatus is in its drawn position. Accordingly, convection air currents are prevented from developing between the bottom of the shade apparatus and the sill. Similarly, a valance in the form of two depending loops 44 is mounted on the undersurface of the horizontal upper portion of frame 14. The loops 44 are sealed at locations 46 to also define dead air spaces 47. Further, each loop may have a low emittance inner surface 49. Therefore, since the loops are positioned to contact the outermost shade sheet 22*f* as it is retracted onto roller 24, they effectively prevent convection currents from developing between the frame and the top of the apparatus and also prevent conductive and radiant heat transmission.

As shown in FIGS. 1 and 7, a resilient seal arrangement, similar to the valance shown in FIG. 3, may be provided for the side of the shade apparatus. This arrangement 48, mounted on the side portions of frame 14, includes a pair of opposing loops 50, sealed at locations 51, and made, for example, from a plastic material having high elastic memory, which are formed to tightly contact the edges of the shade apparatus and prevent convection currents from developing thereby. These loops 50 also enclose dead air spaces 53 and may have low emittance inner surface 55.

As shown in FIG. 6, an alternative loop arrangement 57 may be used for either the top or side seal arrangements shown in FIGS. 3 and 7. This arrangement includes two loops 54 made of a resilient material, formed to press about the shade apparatus as it is retracted onto a roller 24 regardless of its diameter during various stages of shade sheet retraction.

Alternative forms of spacer devices shown in FIGS. 8 through 10, may be used to separate the shade sheets in the manner described above. Each alternative spacer embodiment is shown arranged to be retracted in a clockwise direction onto a roller rather than in a counterclockwise direction as shown in FIG. 3. FIG. 8 shows a spacer device which is integrally formed with its associated shade sheet to extend laterally thereacross. Specifically, each sheet 22 is formed at several vertially spaced locations with a first fold 58 that exceeds the elastic limit of the material from which the sheet is made and, therefore, is permanent. The fold may, for example, be bent in the counterclockwise direction. The sheet is then bent backwardly in the clockwise direction at 60 onto itself to form a loop 62. The face of the sheet 22 adjacent the first permanent fold 58 is bonded, for example, with adhesive or by heat sealing to the contacting face at a location 64. The sheet is then bent in a second permanent fold 66, again in the counterclockwise direction, at a location beyond the bond location 64. Thus, a portion of the sheet extends beyond the bond to form a moment arm 68. When a tension force, such as the weight of the sheet itself, indicated by arrow F, is applied to opposite ends of a shade sheet 22, loop 62 tends to rotate outwardly away from the plane of the sheet about fold 58 as indicated by arrow R. In this manner, loop 62 acts as a lateral spacer between adjacent sheets in order to define a dead air space 38 therebetween. The respective dead air spaces operate as thermal insulators in the same manner described above. The loop 62 is also formed to roll tightly onto a retractor such as roller 24. A second alternative spacer is shown in FIG. 9 and comprises a loop 70 formed of an elongated strip, attached at its upper edge 72 to the shade sheet 22. The lower strip end is curved back and ultimately to be adhered to itself at 75. The loop material has low elastic memory. Therefore, when the shade apparatus is drawn the loop acts to equalize radial forces within it to accordingly assume a nearly circular cylindrical shape and space adjacent sheets apart. However, when retracted onto a roller 24, the loop 70 collapses to permit the shade sheets to be compacted in closely adjacent relation. A third alternative spacer device is shown in FIG. 10 and comprises a tear-shaped loop 80 formed of an elongated strip attached at its common free edges to shade sheet 22 at 82. This material from which loop 80 is formed also has low elastic memory and assumes a bulbous configuration when the apparatus is drawn in an attempt to equalize radial forces therein.

Figure 11:
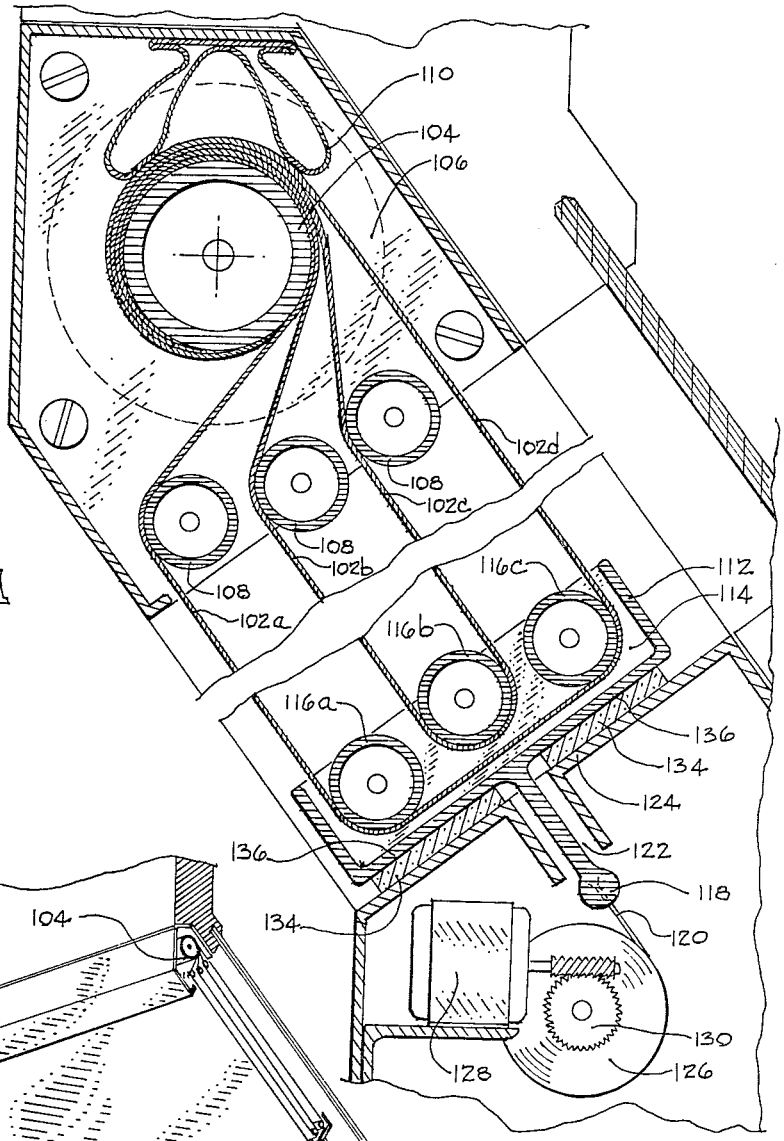
FIG. 11 is a vertical cross-sectional view similar to FIG. 3 of another embodiment of the invention showing still other alternative spacer devices and showing the apparatus mounted to extend at an oblique angle.
Figure 12:
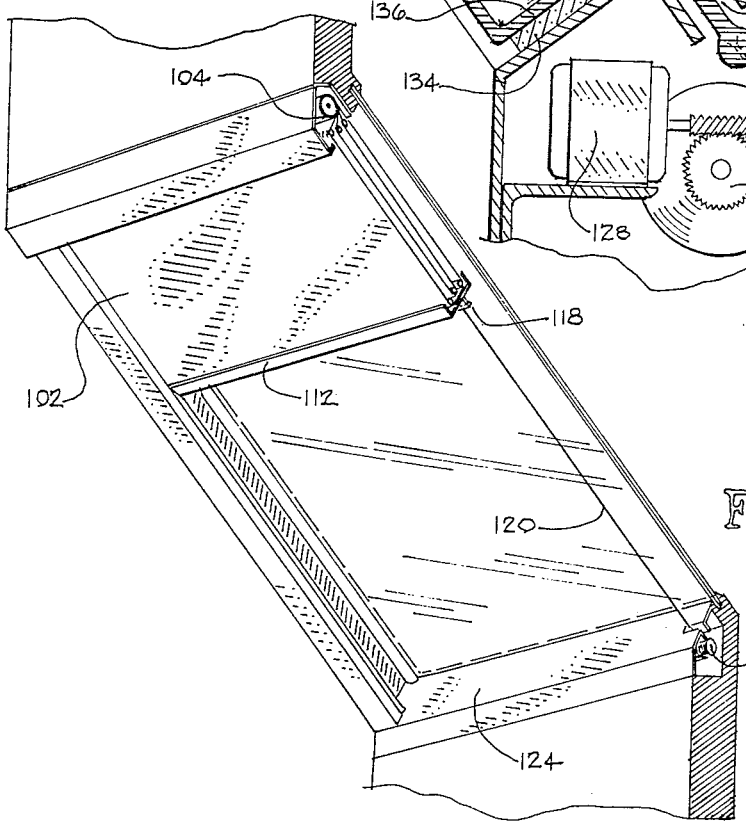
FIG. 12 is a perspective view, partly broken away to show detail of the embodiment shown in FIG. 11.

FIGS. 11 and 12 illustrate another embodiment of the present invention which may be used to insulate any area insulated by embodiment illustrated in FIG. 3. However, this second embodiment has particular utility for insulating areas such as skylights, roofs of greenhouses or any other area that extends at an oblique or horizontal attitude. As shown in FIG. 11, the shade apparatus comprises a plurality of shade sheets 102 which are attached to a roller retracting mechanism 104 in a fashion similar to that described with reference to FIG. 3. The retracting mechanism is mounted between two end brackets 106, only one of which is shown in FIG. 11, that are attached to opposite sides of the area, for example, on opposite sides of a window frame or door jam. Also extending between brackets 106 are a plurality of freely rotatable upper spacer rollers 108, each of which is mounted to contact only one of each pair of adjacent sheets. Each of the spacer rollers is provided with a non-abrasive surface such as soft rubber to prevent degradation of the low emittance surfaces of the sheets described in detail above.

This embodiment may also be equipped with an upper valance 110 such as that described with reference to FIG. 3 to prevent convection air currents from passing over the apparatus. This upper valance as well as the side seals described with reference to the embodiment shown in FIG. 3 may be made of a magnetic material to tightly conform to the apparatus.

At its free end, the shade apparatus comprises a Y-shaped bracket 112 having end plates 114, only one of which is shown in FIG. 11. A number of freely rotatable lower spacer rollers 116, equal to the number of upper spacer rollers 108, are mounted between the end plates 114 in bracket 112. Again, each of the lower rollers is mounted in spaced relation to one another and may have a non-abrasive surface in order to prevent roller binding of adjacent sheets.

The outer most shade sheets 102*a* and 102*d* are in fact a single continuous sheet which is reeved about the two outermost lower spacer rollers 116*a* and 116*c*. Similarly, the innermost shade sheets 102*b* and 102*c* comprise single continuous sheet which is reeved about the center lower spacer roller 116*b*.

The depending leg 118 of the Y-shaped bracket 112 is attached to a tension cord or cable 120 which passes through a suitable slot 122 in the sill 124 of the area to be insulated. The cable 120 is wound about a drum 126 which may be driven by a motor 128 through a worn gear drive arrangement 130, or by hand crank or pulley not shown.

It can be appreciated, then, that the shade apparatus may be pulled to its drawn position shown in FIG. 11 from its retracted position near that shown in FIG. 12 by the motor 128 operating the drive arrangement 130, drum 126 and cable 120. Further, it will be appreciated that the fixed spacer arrangement of the second embodiment is particularly useful in applications where the shade apparatus is mounted at an oblique angle such as that illustrated. This fixed spacer arrangement supports each of the sheets 102 of the multilayer apparatus in spaced relation through the tensioning provided by the cable drive. It is also desirable to provide the retracting roller 104 with a strong spring or other motor to insure that adequate tensioning exists between the top and bottom of the apparatus.

As shown in FIG. 11, a resiliant or magnetic seal 134 may be provided on the top of sill 124 to abut the horizontal arms 136 of the Y-shaped bracket 112 when the apparatus is in the drawn position. These seals further prevent convection air current from arising beneath the apparatus in the drawn position.

FIGS. 13 through 16 illustrate four alternative spacer arrangements which have particular utility in the embodiment of the invention illustrated in FIGS. 11 and 12 when the adjacent shade sheets extend in an oblique or horizontal attitude.

Figure 13:
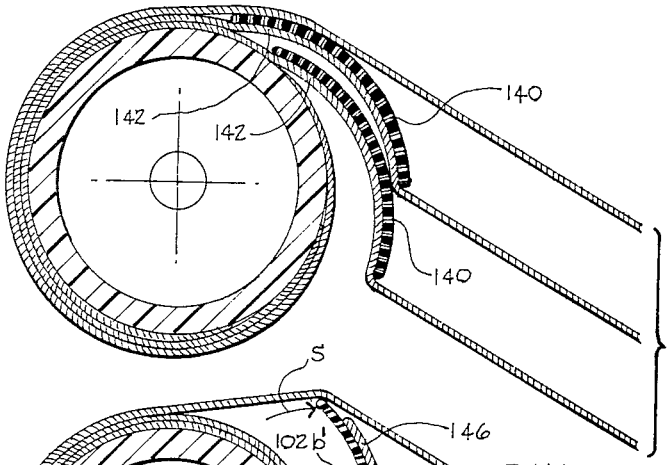
FIGS. 13, 14, 15, and 16 are vertical cross-sectional views of alternative spacer devices which are particularly useful in the embodiment of the invention shown in FIGS. 11 and 12.

The first form of spacer shown in FIG. 13 is similar to that described with reference to FIG. 3. However, the spacer device 140 illustrated is formed of an elongated strip of rigid material which has a partially cylindrical or arcuate shape having an axis parallel to the major axis of the strip and is attached, for example, by heat welding, sewing, or adhesive on its entire surface or at its upper edge 142 to the sheet surface to extend horizontally or transversely across. Rather then having multiple spacers extending through the shade apparatus, only a single spacer is attached to one of each pair of shade sheets in the region of attachment of the sheets to the roller. Since the spacers 140 are rigid, when the apparatus is moved to its drawn position, the sheets are effectively separated as shown in FIG. 13.

Figure 14:
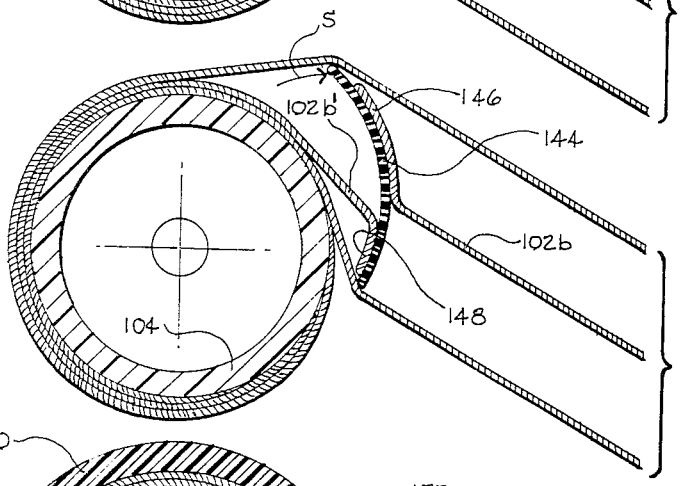

FIG. 14 illustrates an alternative spacer which operates by a principle similar to that of the embodiment illustrated in FIG. 8. This spacer device comprises a rigid strip which has a partially cylindrical or arcuate cross section having an axis parallel to the major axis of the strip. At one edge 146 of the strip, on one face thereof, the spacer is attached to a lower section of the shade sheet 102*b*. On its opposite face and opposite edge 148, the spacer is attached also to an upper section of the central shade sheet 102*b*'. Accordingly, as shown in FIG. 14, when tension is placed on this shade sheet the spacer device 144 tends to rotate to a position not parallel to the shade sheet. In other words, the spacer tends to rotate outwardly away from the plane of the sheet as indicated by arrow S. In this manner, the spacer acts as a lateral divider between adjacent sheets in order to define dead spaces therebetween. When the apparatus is retracted, the spacer may fold against the shade sheets to tightly compact against the roller 104.

Figure 15:
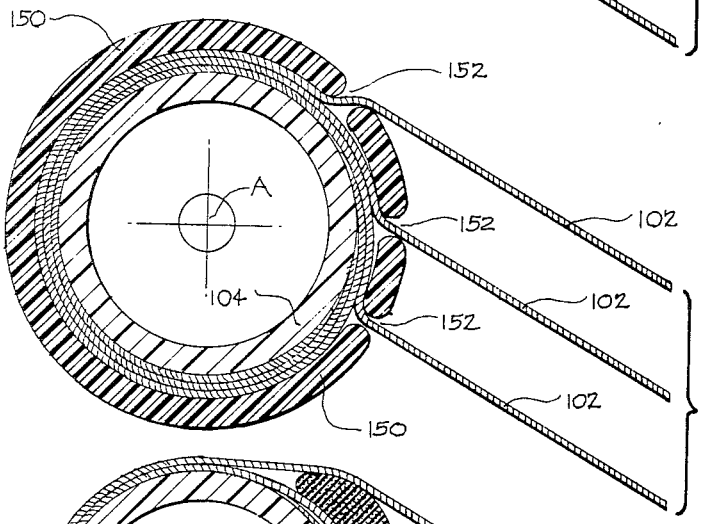

FIG. 15 illustrates a fixed spacer that comprises a drum 150 which is concentric with and encircles the retracting roller 104. The drum is provided with several slots 152 which extend in the direction of its axis A. Each shade sheet 102 is threaded through one of the slots 152. The drum 150 is mounted with roller 104 to dispose slots 152 is spaced relation transversely to the plane of the extended shade sheets when the sheets are in their fully drawn position as shown in FIG. 15.

Figure 16:
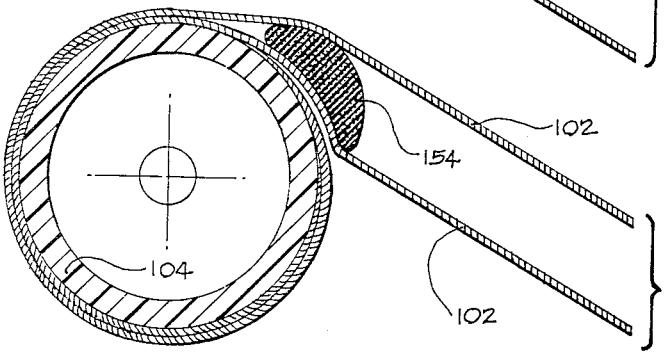

FIG. 16 illustrates perhaps one of the least expensive spacer embodiments in the form of a solid elongated foam cam member 154 which is attached to one of the shade sheets 102, in the region of the attachment of both sheets to the roller 104. The cam member extends transversely across the sheets. This spacer configuration has particular utility in situations where only two shade sheets are employed and where cost is an important factor.

FIGS. 17 through 19 illustrate automatically and remotely operable embodiments of the apparatus of the present invention. In FIG. 17, the shade may be moved to its drawn and retracted positions by a motor 160 which powers a worm gear 162 and a worm wheel 164 that moves the roller 104 on which the multilayer shade apparatus is mounted. The motor 160 may be automatically driven by a photovoltaic cell as described in greater detail below or may be selectively actuated by a manual switch. Further, the motor shaft 166 may be rotated through a pulley 168 about which is reeved a pull cord 170. This alternative arrangement permits manual operation of the shade apparatus.

It may be desirable to enclose the apparatus between two panes of transparent material 220 such as glass. The panes serve to minimize convection air current which might arise between the parallel sheets of the apparatus. A slight vacuum may be maintained in the space defined between the panes to further suppress convection losses.

FIGS. 18 and 19 illustrate a self-contained motor drive arrangement for the apparatus of the invention. This embodiment includes a power system, mounted inside the roller tube 104, that includes a flat blade 180 which may be engaged in a conventional mounting bracket 182 fixed to a window frame 184. The blade 180 includes separate portions 186 and 188 respectively which are separated by a solid insulating shaft 190. Each of the separate portions of the blade 180 are contacted by suitable spring contacts 192 and 194 mounted inside the bracket 182. Further, the electrically separate portions are connected through the shaft 190 to a commutator 196 which is adapted to make electrical connection with two brushes 198 and 200. The brushes are, in turn, connected to a motor 202 and a microcomputer 204. The motor has a shaft 206 equipped with a pinion 208 that drives a gear 210 that in turn drives a gear reduction assembly mounted in a gear box 215. Gear 212 engages gear 214 that is non-rotatably mounted with the fixed shaft 190. Accordingly, when the motor is actuated, the shade is rotated through an interaction with the fixed shaft 190. Antifriction bearings 216 are provided to facilitate free rotation of the shade apparatus.

The exterior contacts 192 and 194 are coupled to a photovoltaic cell 218 which is mounted on the window 220 in which the apparatus of the invention is installed as shown in FIG. 18. The photovoltaic cell is actuated by incident light from the exterior environment. The microcomputer 204 is desirably programmed to move the apparatus to its drawn position during the daylight hours in the air conditioning season. Similarly, in the air conditioning season, the apparatus is moved to its retracted position at night. During the heating season, to converse is true. In particular, the microcomputer is programmed to actuate the motor to move the apparatus to its drawn position at night during the heating season and to its retracted position during the day during the heating season.

It will be appreciated from the above description, that many forms of the present invention may be conceived. It is adaptable to various environments to serve specific insulating requirements.

It has been found that use of the apparatus of the present invention throughout the year can result in substantial conservation of energy. When used during the winter, this apparatus prevents substantial heat loss from the interior to the exterior of a building opening in which it is installed. The apparatus can be most effectively used during the winter months at night. Similarly, during the summer months, the apparatus of the present invention prevents substantial unwanted heat from entering the building from its exterior through the building opening. By way of example, it has been found that the preferred embodiment of the present invention having six shade sheets and enclosing five dead air spaces yields the following results:

TABLE I

| | | Results without Shade Apparatus | Results with Shade Apparatus |
|---|---|---|---|
| Single Glass Pane Window | R | .96 | 16.67 |
| | U | 1.04 | .060 |
| Insulated Glass Pane Window | R | 1.54 | 17.25 |
| | U | .65 | .058 |

These results were obtained when both sides of each interior shade sheet are provided with a low surface emittance surface facing on a dead air space and the emissivity E of each dead air space is equal to 0.03. It is apparent that this apparatus represents a sixteen-fold improvement over an uncovered window in preventing heat transmission when all other variables are maintained at constant values.

Note that the present invention may be practiced with more or less than six shade sheets. However, it has been found that the minimum number of sheets which provide acceptable results is three, thus enclosing two dead air spaces. Such a shade apparatus yields the following results:

TABLE 2

| | | Results without Shade Apparatus | Results with Shade Apparatus |
|---|---|---|---|
| Single Glass Pane Window | R | .96 | 7.82 |
| | U | 1.04 | .128 |
| Insulated Glass Pane Window | R | 1.54 | 8.40 |
| | U | .65 | .119 |

This apparatus then yields an eight-fold improvement over the single pane window in preventing convective, conductive, and radiant heat transmission again when all other variables are maintained at constant values.

Therefore, in its preferred embodiments, the apparatus of the present invention is extremely effective in preventing thermal heat losses to provide substantial conservation of energy.

Although specific embodiments of the present invention have been described above in detail, it is to be understood that this is only for purposes of illustration. Modifications may be made to the described structures in order to adapt this invention to particular insulating applications.

What is claimed is:

1. An apparatus for insulating an area such as a window, door, or wall against conductive, convective and radiant heat transmission comprising:

A. a plurality of essentially non-transparent imperforate, shade sheets;

B. retracting means including a single retracting roller to which all shade sheets are attached to be rolled thereon for mounting said sheets for selective movement between a drawn position covering the area and a retracted position not covering the area; and C. spacer means mounted to separate adjacent sheets to provide a dead space therebetween, said spacer means including one spacer roller for each pair of sheets, each said spacer roller being mounted for free sheet nonabrading rotation in fixed relation to said retracting roller to contact only one of each pair of sheets when in the drawn position.

2. The apparatus for insulating an area against conductive, convective, and radiant heat transmission as claimed in claim 1 further comprising:

seal means for preventing convection air currents from developing between said apparatus and the area.

3. The apparatus for insulating an area against conductive, convective, and radiant heat transmission as claimed in claim 1 wherein said apparatus is mounted at an upper portion of the area to be drawn down over it from said retracting means; wherein the area has a bottom sill surface, and wherein said seal means comprises;

a flexible flap mounted with the outermost sheet opposite the area to rest on the sill surface and prevent air currents from flowing under said apparatus.

4. The apparatus for insulating an area against conductive, convective, and radiant heat transmission as claimed in claim 1 wherein said seal means comprises:

a flexible seal mounted with the area to engage the sides of said shade sheets when in the drawn position to prevent convection air currents from flowing thereby.

5. The apparatus for insulating an area against conductive, convective, and radiant heat transmission as claimed in claim 1 wherein said apparatus is mounted at an upper portion of the area to be drawn down over it from said retracting means and wherein said seal means comprises:

a flexible valance mounted at the top of the area to contact said shade sheets mounted with said retracting means when in both the drawn and retracted positions and to prevent convection air currents from flowing past the top of said apparatus.

6. The apparatus for insulating an area against conductive, convective, and radiant heat transmission as calimed in claim 1 further comprising:

a pair of mutually parallel transparent panes mounted in the area, said apparatus being mounted to be moved to its drawn position between said panes.

7. The apparatus for insulating an area against conductive, convective, and radiant heat transmission as claimed in claim 1 wherein said shade sheets extends at an angle to the vertical when in the drawn position.

8. The apparatus for insulating an area against conductive, convective, and radiant heat transmission as claimed in claim 1 wherein said retracting means is arranged to urge said shade sheets toward their retracted position and wherein said apparatus further comprises:

tensioning means for urging said shade sheets toward their drawn position to hold them at an angle to the vertical.

9. The apparatus for insulating an area against conductive, convective and radiant heat transmission as claimed in claim 1 wherein said roller is provided with a nonabrading surface.

10. The apparatus for insulating an area against conductive, convective and radiant heat transmission as claimed in claim 19 further comprising:

a low emittance surface associated with at least one of said shade sheets, facing on said dead space, said surface having a surface emittance which is sufficiently low to yield a total effective emissivity of said surface and dead space of no greater than 0.60.

11. The apparatus for insulating an area against conductive, convective, and radiant heat transmission as claimed in claim 10 wherein said total effective emissivity of said surface and dead space is no greater than 0.06.

12. The apparatus for insulating an area against conductive, convective, and radiant heat transmission as claimed in claim 10 wherein the surface emittance of said surface is no greater than 0.60.

13. The apparatus for insulating an area against conductive, convective, and radiant heat transmission as claimed in claim 10 wherein the surface emittance of said surface is no greater than 0.06.

14. The apparatus for insulating an area against conductive, convective, and radiant heat transmission as claimed in claim 10 wherein said total effective emissivity of said surface and dead space of no greater than 0.60 is achieved in the infrared range of the radiant energy spectrum.

15. The apparatus for insulating an area against conductive, convective, and radiant heat transmission as claimed in claim 10 wherein said total effective emissivity of said surface and dead space of no greater than 0.60 is achieved in the temperature range of 30° F. to 130° F.

16. The apparatus for insulating an area against conductive, convective, and radiant heat transmission as claimed in claim 10 wherein said total effective emissivity of said surface and dead space of no greater than 0.60 is achieved in the infrared range of the energy spectrum and in the temperature range of 30° F. to 130° F.

17. The apparatus for insulating an area against conductive, convective, and radiant heat transmission as claimed in claim 10 wherein the two outermost shade sheets of said plurality are interconnected at at least one end, one end to seal said dead spaces defined between adjacent sheets and thereby prevent convection air currents from developing in said dead spaces.

18. The apparatus for insulating an area against conductive, convective, and radiant heat transmission as claimed in claim 17 wherein the two outermost shade sheets of said plurality are continuously formed on the same sheet of material.

19. An apparatus for insulating an area such as a window, door, or wall against conductive, convective and radiant heat transmission comprising:

A. a plurality of essentially non-transparent imperforate, shade sheets;

B. retracting means for mounting said sheets for selective movement between a drawn position covering the area and a retracted position not covering the area; and C. spacer means mounted to separate adjacent sheets to provide a dead space therebetween, said spacer means comprising at least one spacer device which comprises an elongated strip formed of rigid substantially inflexible sheet material having an arcuate cross sectional shape with an axis extending in the direction of the major dimension of said strip, one of the edges of said strip extending in the direction of the axis, being attached to one of said sheets.

20. The apparatus for insulating an area against conductive, convective and radiant heat transmission as claimed in claim 19 wherein said retracting means is a roller and wherein said elongated strip is attached to said sheet to curve in the same direction as said roller when said sheet is retracted thereon.

21. The apparatus for insulating an area against conductive, convective and radiant heat transmission as claimed in claim 19 further comprising:

a low emittance surface associated with at least one of said shade sheets, facing on said dead space, said surface having a surface emittance which is sufficiently low to yield a total effective emissivity of said surface and dead space of no greater than 0.60.

22. The apparatus for insulating an area against conductive, convective and radiant heat transmission as claimed in claim 21 wherein said total effective emissivity of said surface and dead space is no greater than 0.06.

23. The apparatus for insulating an area against conductive, convective, and radiant heat transmission as claimed in claim 21 wherein the surface emittance of said surface is no greater than 0.60.

24. The apparatus for insulating an area against conductive, convective and radiant heat transmission as claimed in claim 21 wherein the surface emittance of said surface is no greater than 0.06.

25. The apparatus for insulating an area against conductive, convective and radiant heat transmission as claimed in claim 21 wherein said total effective emissivity of said surface and dead space of no greater than 0.60 is achieved in the infrared range of the radiant energy spectrum.

26. The apparatus for insulating an area against conductive, convective and radiant heat transmission as claimed in claim 21 wherein said total effective emissivity of said surface and dead space of no greater than 0.60 is achieved in the temperature range of 30° F. to 130° F.

27. The apparatus for insulating an area against conductive, convective and radiant heat transmission as claimed in claim 21 wherein said total effective emissivity of said surface and dead space of no greater than 0.60 is achieved in the infrared range of the energy spectrum and in the temperature range of 30° F. to 130° F.

28. The apparatus for insulating an area against conductive, convective and radiant heat transmission as claimed in claim 19 wherein the two outermost shade sheets of said plurality are interconnected at at least one end, to seal said dead spaces defined between adjacent sheets and thereby prevent convection air currents from developing in said dead spaces.

29. The apparatus for insulating an area against conductive, convective and radiant heat transmission as claimed in claim 28 wherein the two outermost shade sheets of said plurality are continuously formed on the same sheet of material.

30. The apparatus for insulating an area against conductive, convective and radiant heat transmission as claimed in claim 19 further comprising:

seal means for preventing convection air currents from developing between said apparatus and the area.

31. The apparatus for insulating an area against conductive, convective and radiant heat transmission as claimed in claim 19 wherein said apparatus is mounted at an upper portion of the area to be drawn down over it from said retracting means; wherein the area has a bottom sill surface, and wherein said seal means comprises:

a flexible flap mounted with the outermost sheet opposite the area to rest on the sill surface and prevent air currents from flowing under said apparatus.

32. The apparatus for insulating an area against conductive, convective and radiant heat transmission as claimed in claim 19 wherein said seal means comprises:

a flexible seal mounted with the area to engage the sides of said shade sheets when in the drawn position to prevent convection air currents from flowing thereby.

33. The apparatus for insulating an area against conductive, convective and radiant heat transmission as claimed in claim 19 wherein said apparatus is mounted at an upper portion of the area to be drawn down over it from said retracting means and wherein said seal means comprises:

a flexible valance mounted at the top of the area to contact said shade sheets mounted with said retracting means when in both the drawn and retracted positions and to prevent convection air currents from flowing past the top of said apparatus.

34. The apparatus for insulating an area against conductive, convective and radiant heat transmission as claimed in claim 19 further comprising:

a pair of mutually parallel transparent panes mounted in the area, said apparatus being mounted to be moved to its drawn position between said panes.

35. The apparatus for insulating an area against conductive, convective and radiant heat transmission as claimed in claim 19 wherein said shade sheets extend at an angle to the vertical when in the drawn position.

36. The apparatus for insulating an area against conductive, convective and radiant heat transmission as claimed in claim 19 wherein said retracting means is arranged to urge said shade sheets toward their retracted position and wherein said apparatus further comprises:

tensioning means for urging said shade sheets toward their drawn position to hold them at an angle to the vertical.

37. An apparatus for insulating an area such as a window, door or wall against conductive, convective and radiant heat transmission comprising:

A. a plurality of essential non-transparent imperforate, shade sheets;

B. retracting means for mounting said sheets for selective movement between a drawn position covering the area and a retracted position not covering the area; and C. spacer means mounted to separate adjacent sheets to provide a dead space therebetween, said spacer means comprising at least one spacer device which comprises an elongated strip formed of rigid substantially inflexible sheet material having an arcuate cross-sectional shape with an axis extending in the direction of the major dimension of said strip, said sheet being attached to one face of said strip adjacent one edge of said strip which extends in the direction of the axis said sheet being attached to the other face of said strip adjacent the opposite edge of said strip whereby tension applied to said sheet causes said strip to rotate toward a position generally perpendicular to the surface of said sheet.

38. The apparatus for insulating an area against conductive, convective and radiant heat transmission as claimed in claim 37 further comprising:

a low emittance surface associated with at least one of said shade sheets, facing on said dead space, said surface having a surface emittance which is sufficiently low to yield a total effective emissivity of said surface and dead space of no greater than 0.60.

39. The apparatus for insulating an area against conductive, convective and radiant heat transmission as claimed in claim 38 wherein said total effective emissivity of said surface and dead space is no greater than 0.06.

40. The apparatus for insulating an area against conductive, convective and radiant heat transmission as claimed in claim 38 wherein the surface emittance of said surface is no greater than 0.60.

41. The apparatus for insulating an area against conductive, convective and radiant heat transmission as claimed in claim 38 wherein the surface emittance of said surface is no greater than 0.06.

42. The apparatus for insulating an area against conductive, convective and radiant heat transmission as claimed in claim 38 wherein said total effective emissivity of said surface and dead space of no greater than 0.60 is achieved in the infrared range of the radiant energy spectrum.

43. The apparatus for insulating an area against conductive, convective and radiant heat transmission as claimed in claim 38 wherein said total effective emissivity of said surface and dead space of no greater than 0.60 is achieved in the temperature range of 30° F. to 130° F.

44. The apparatus for insulating an area against conductive, convective and radiant heat transmission as claimed in claim 38 wherein said total effective emissivity of said surface and dead space of no greater than 0.60 is achieved in the infrared range of the radiant energy spectrum and in the temperature range of 30° F. to 130° F.

45. The apparatus for insulating an area against conductive, convective and radiant heat transmission as claimed in claim 37 wherein the two outermost shade sheets of said plurality are interconnected at at least one end, to seal said dead spaces defined between adjacent sheets and thereby prevent convection air currents from developing in said dead spaces.

46. The apparatus for insulating an area against conductive, convective and radiant heat transmission as claimed in claim 45 wherein the two outermost shade sheets of said plurality are continuously formed on the same sheet of material.

47. The apparatus for insulating an area against conductive, convective and radiant heat transmission as claimed in claim 37 further comprising:

seal means for preventing convection air currents from developing between said apparatus and the area.

48. The apparatus for insulating an area against conductive, convective and radiant heat transmission as claimed in claim 37 wherein said apparatus is mounted at an upper portion of the area to be drawn down over it from said retracting means; wherein the area has a bottom sill surface, and wherein said seal means comprises:

a flexible flap mounted with the outermost sheet opposite the area to rest on the sill surface and prevent air currents from flowing under said apparatus.

49. The apparatus for insulating an area against conductive, convective and radiant heat transmission as claimed in claim 37 wherein said seal means comprises:

a flexible seal mounted with the area to engage the sides of said shade sheets when in the drawn position to prevent convection air currents from flowing thereby.

50. The apparatus for insulating an area against conductive, convective and radiant heat transmission as claimed in claim 37 wherein said apparatus is mounted at an upper portion of the area to be drawn down over it from said retracting means and wherein said seal means comprises:

a flexible valance mounted at the top of the area to contact said shade sheets mounted with said retracting means when in both the drawn and retracted positions and to prevent convection air currents from flowing past the top of said apparatus.

51. The apparatus for insulating an area against conductive, convective and radiant heat transmission as claimed in claim 37 further comprising:

a pair of mutually parallel transparent panes mounted in the area, said apparatus being mounted to be moved to its drawn position between said panes.

52. The apparatus for insulating an area against conductive, convective and radiant heat transmission as claimed in claim 37 wherein said shade sheets extend at an angle to the vertical when in the drawn position.

53. The apparatus for insulating an area against conductive, convective and radiant heat transmission as claimed in claim 37 wherein said retracting means is arranged to urge said shade sheets toward their retracted position and wherein said apparatus further comprises:

tensioning means for urging said shade sheets toward their drawn position to hold them at an angle to the vertical.

54. An apparatus for insulating an area such as a window, door, or wall against conductive, convective and radiant heat transmission comprising:

A. a plurality of essentially non-transparent imperforate, shade sheets;

B. retracting means including a single retracting roller to which all shade sheets are attached to be rolled thereon for mounting said sheets for selective movement between a drawn position covering the area and a retracted position not covering the area; and C. spacer means mounted to separate adjacent sheets to provide a dead space therebetween, said spacer means comprising a cylindrical member associated in coaxial relation with said retracting roller, having a plurality of spaced parallel slots extending in the direction of the axis thereof, one of said sheets passing through each of said slots, said member being arranged to space said slots apart in a direction not parallel to said sheets when said apparatus is in the drawn position.

55. The apparatus for insulating an area against conductive, convective and radiant heat transmission as claimed in claim 54 further comprising:

a low emittance surface associated with at least one of said shade sheets, facing on said dead space, said surface having a surface emittance which is sufficiently low to yield a total effective emissivity of said surface and dead space of no greater than 0.60.

56. The apparatus for insulating an area against conductive, convective and radiant heat transmission as claimed in claim 55 wherein said total effective emissivity of said surface and dead space is no greater than 0.06.

57. The apparatus for insulating an area against conductive, convective and radiant heat transmission as claimed in claim 55 wherein the surface emittance of said surface is no greater than 0.60.

58. The apparatus for insulating an area against conductive, convective and radiant heat transmission as claimed in claim 55 wherein the surface emittance of said surface is no greater than 0.06.

59. The apparatus for insulating an area against conductive, convective and radiant heat transmission as claimed in claim 55 wherein said total effective emissivity of said surface and dead space of no greater than 0.60 is achieved in the infrared range of the radiant energy spectrum.

60. The apparatus for insulating an area against conductive, convective and radiant heat transmission as claimed in claim 55 wherein said total effective emissivity of said surface and dead space of no greater than 0.60 is achieved in the temperature range of 30° F. to 130° F.

61. The apparatus for insulating an area against conductive, convective and radiant heat transmission as claimed in claim 55 wherein said total effective emissivity of said surface and dead space of no greater than 0.60 is achieved in the infrared range of the energy spectrum and in the temperature range of 30° F. to 130° F.

62. The apparatus for insulating an area against conductive, convective and radiant heat transmission as claimed in claim 54 wherein the two outermost shade sheets of said plurality are interconnected at at least one end, to seal said dead spaces defined between adjacent sheets and thereby prevent convection air currents from developing in said dead spaces.

63. The apparatus for insulating an area against conductive, convective and radiant heat transmission as claimed in claim 62 wherein the two outermost shade sheets of said plurality are continuously formed on the same sheet of material.

64. The apparatus for insulating an area against conductive, convective and radiant heat transmission as claimed in claim 54 further comprising:

seal means for preventing convection air currents from developing between said apparatus and the area.

65. The apparatus for insulating an area against conductive, convective and radiant heat transmission as claimed in claim 54 wherein said apparatus is mounted at an upper portion of the area to be drawn down over it from said retracting means; wherein the area has a bottom sill surface, and wherein said seal means comprises:

a flexible flap mounted with the outermost sheet opposite the area to rest on the sill surface and prevent air currents from flowing under said apparatus.

66. The apparatus for insulating an area against conductive, convective and radiant heat transmission as claimed in claim 54 wherein said seal means comprises:

a flexible seal mounted with the area to engage the sides of said shade sheets when in the drawn position to prevent convection air currents from flowing thereby.

67. The apparatus for insulating an area against conductive, convective and radiant heat transmission as claimed in claim 54 wherein said apparatus is mounted at an upper portion of the area to be drawn down over it from said retracting means and wherein said seal means comprises:

a flexible valance mounted at the top of the area to contact said shade sheets mounted with said retracting means when in both the drawn and retracted positions and to prevent convection air currents from flowing past the top of said apparatus.

68. The apparatus for insulating an area against conductive, convective and radiant heat transmission as claimed in claim 54 further comprising:

a pair of mutually parallel transparent panes mounted in the area, said apparatus being mounted to be moved to its drawn position between said panes.

69. The apparatus for insulating an area against conductive, convective and radiant heat transmission as claimed in claim 54 wherein said shade sheets extend at an angle to the vertical when in the drawn position.

70. The apparatus for insulating an area against conductive, convective and radiant heat transmission as claimed in claim 54 wherein said retracting means is arranged to urge said shade sheets toward their retracted position and wherein said apparatus further comprises:

tensioning means for urging said shade sheets toward their drawn position to hold them at an angle to the vertical.

71. An apparatus for insulating an area such as a window, door or wall against conductive, convective and radiant heat transmission comprising:

A. a plurality of essentially non-transparent imperforate, shade sheets;

B. retracting means comprising a single retracting roller to which all shade sheets are attached to be rolled thereon for mounting said sheets for selective movement between a drawn position covering the area and a retracted position not covering the area; and C. spacer means mounted to separate adjacent sheets to provide a dead space therebetween, said spacer means comprising a cam member mounted on one of each pair of sheets in the region of the attachment of said sheets to said retracting roller.

72. The apparatus for insulating an area against conductive, convective and radiant heat transmission as claimed in claim 71 further comprising:

a low emittance surface associated with at least one of said shade sheets, facing on said dead space, said surface having a surface emittance which is sufficiently low to yield a total effective emissivity of said surface and dead space of no greater than 0.60.

73. The apparatus for insulating an area against conductive, convective and radiant heat transmission as claimed in claim 72 wherein said total effective emissivity of said surface and dead space is no greater than 0.06.

74. The apparatus for insulating an area against conductive, convective and radiant heat transmission as claimed in claim 72 wherein the surface emittance of said surface is no greater than 0.60.

75. The apparatus for insulating an area against conductive, convective and radiant heat transmission as claimed in claim 72 wherein the surface emittance of said surface is no greater than 0.06.

76. The apparatus for insulating an area against conductive, convective and radiant heat transmission as claimed in claim 72 wherein said total effective emissivity of said surface and dead space of no greater than 0.60 is achieved in the infrared range of the radiant energy spectrum.

77. The apparatus for insulating an area against conductive, convective and radiant heat transmission as claimed in claim 72 wherein said total effective emissivity of said surface and dead space of no greater than 0.60 is achieved in the temperature range of 30° F. to 130° F.

78. The apparatus for insulating an area against conductive, convective and radiant heat transmission as claimed in claim 72 wherein said total effective emissivity of said surface and dead space of no greater than 0.60 is achieved in the infrared range of the energy spectrum and in the temperature range of 30° F. to 130° F.

79. The apparatus for insulating an area against conductive, convective and radiant heat transmission as claimed in claim 71 wherein the two outermost shade sheets of said plurality are interconnected at at least one end, to seal said dead spaces defined between adjacent sheets and thereby prevent convection air currents from developing in said dead spaces.

80. The apparatus for insulating an area against conductive, convective and radiant heat transmission as claimed in claim 79 wherein the two outermost shade sheets of said plurality are continuously formed on the same sheet of material.

81. The apparatus for insulating an area against conductive, convective and radiant heat transmission as claimed in claim 71 further comprising:

seal means for preventing convection air currents from developing between said apparatus and the area.

82. The apparatus for insulating an area against conductive, convective and radiant heat transmission as claimed in claim 71 wherein said apparatus is mounted at an upper portion of the area to be drawn down over it from said retracting means; wherein the area has a bottom sill surface, and wherein said seal means comprises:

a flexible flap mounted with the outermost sheet opposite the area to rest on the sill surface and prevent air currents from flowing under said apparatus.

83. The apparatus for insulating an area against conductive, convective and radiant heat transmission as claimed in claim 71 wherein said seal means comprises:

a flexible seal mounted with the area to engage the sides of said shade sheets when in the drawn position to prevent convection air currents from flowing thereby.

84. The apparatus for insulating an area against conductive, convective and radiant heat transmission as claimed in claim 71 wherein said apparatus is mounted at an upper portion of the area to be drawn down over it from said retracting means and wherein said seal means comprises:

a flexible valance mounted at the top of the area to contact said shade sheets mounted with said retracting means when in both the drawn and retracted positions and to prevent convection air currents from flowing past the top of said apparatus.

85. The apparatus for insulating an area against conductive, convective and radiant heat transmission as claimed in claim 71 further comprising:

a pair of mutually parallel transparent panes mounted in the area, said apparatus being mounted to be moved to its drawn position between said panes.

86. The apparatus for insulating an area against conductive, convective and radiant heat transmission as claimed in claim 71 wherein said shade sheets extend at an angle to the vertical when in the drawn position.

87. The apparatus for insulating an area against conductive, convective and radiant heat transmission as claimed in claim 71 wherein said retracting means is arranged to urge said shade sheets toward their retracted position and wherein said apparatus further comprises:

tensioning means for urging said shade sheets toward their drawn position to hold them at an angle to the verticle.

88. An apparatus for insulating an area such as a window, door, or wall against conductive, convective and radiant heat transmission comprising:

A. a plurality of essentially non-transparent imperforate, shade sheets;

B. retracting means for mounting said sheets for selective movement between a drawn position covering the area and a retracted position not covering the area; and C. spacer means mounted to separate adjacent sheets to provide a dead space therebetween, and D. means for actuating said retracting in response to environmental conditions on the exterior of said area.

89. The apparatus for insulating an area against conductive, convective and radiant heat transmission as claimed in claim 88 wherein said actuating means comprises A. motor means for driving said retracting means to move said sheets between the drawn and retracted positions; and B. sensor means for detecting the environmental condition.

90. The apparatus for insulating an area against conductive, convective and radiant heat transmission as claimed in claim 89 wherein said sensor means comprises a photosensor.

91. The apparatus for insulating an area against conductive, convective and radiant heat transmission as claimed in claim 90 further comprising:

a microcomputer, connected to photosensor and said motor means, programmed to actuate said motor means to move said sheets to the drawn position during the daylight hours and retracted position at night in the air conditioning season and to move said sheets to the drawn position at night and retracted position during the daylight hours in the heating season.

* * * * *

UNITED STATES PATENT AND TRADEMARK OFFICE

CERTIFICATE OF CORRECTION

PATENT NO. : 4,194,550

DATED : March 25, 1980

INVENTOR(S) : Thomas P. Hopper

It is certified that error appears in the above-identified patent and that said Letters Patent are hereby corrected as shown below:

In the Abstract, line 15, change "Important," to read -- Importantly, --.

Column 2, line 17, cancel "conventional", first occurrence.

Column 6, line 56, change "dead space 38 is 0.060." to read -- dead space 38 is 0.60. --.

Column 8, line 30, change "vertially" to -- vertically --.

Column 9, line 50, change "motor 128 through a worn" to read -- motor 128 through a worm --.

Column 10, line 51, change "dispose slots 152 is spaced" to read -- dispose slots 152 in spaced".

Column 11, line 49, change "the heating season, to" to read -- the heating season, the --.

Column 13, line 41, change "calimed" to -- claimed --.

Line 47, change "shade sheets extends at" to read -- shade sheets extend at --.

Line 4 from the bottom, change "claim 19" to -- claim 1 --.

UNITED STATES PATENT AND TRADEMARK OFFICE

CERTIFICATE OF CORRECTION

PATENT NO. : 4,194,550

DATED : March 25, 1980

INVENTOR(S) : Thomas P. Hopper

It is certified that error appears in the above-identified patent and that said Letters Patent are hereby corrected as shown below:

Column 14, line 36, change "end, one end to seal" to read -- end, to seal --.

Column 15, line 37, change "range of the energy spectrum" to read -- range of the radiant energy spectrum --.

Column 16, line 42, change "a plurality of essential non-transparent" to read -- a plurality of essentially non-transparent --.

Signed and Sealed this

*Twenty-eighth* Day of *October 1980*

[SEAL]

*Attest:*

SIDNEY A. DIAMOND

*Attesting Officer*

*Commissioner of Patents and Trademarks*